US005366213A

United States Patent [19]

Polachak et al.

[11] Patent Number: 5,366,213

[45] Date of Patent: Nov. 22, 1994

[54] METHOD FOR HANDLING DOCUMENTS AT A HIGH VOLUME SCANNER

[75] Inventors: Nicholas G. Polachak; Robert J. Brasch, both of Rochester, N.Y.

[73] Assignee: Eastman Kodak Company, Rochester, N.Y.

[21] Appl. No.: 159,023

[22] Filed: Nov. 29, 1993

[51] Int. Cl.[5] ..... B65H 5/22; B65H 1/00; B65D 85/48

[52] U.S. Cl. ..... 271/3; 271/145; 271/163; 271/207; 206/449; 206/555

[58] Field of Search ..... 271/1, 3, 241, 236, 271/245, 145, 162, 163, 207, 213, 220; 206/449, 555; 220/324

[56] References Cited

U.S. PATENT DOCUMENTS

| | | | |
|---|---|---|---|
| 3,061,304 | 10/1962 | Smith | 271/163 X |
| 3,161,003 | 12/1964 | Grintz | 53/255 |
| 3,232,397 | 2/1966 | McCoy | 206/555 X |
| 3,391,698 | 7/1968 | Wiles | 129/15 |
| 3,471,996 | 10/1969 | Kingham | 53/390 |
| 3,919,972 | 11/1975 | Komori et al. | 271/118 |
| 4,023,842 | 5/1977 | Harvey | 294/1 |
| 4,268,081 | 5/1981 | Hawkinson | 294/55 |
| 4,456,240 | 6/1984 | Chu et al. | 271/4 |
| 4,482,116 | 11/1984 | Vadnais | 248/99 |
| 4,525,063 | 6/1985 | Eisbein | 355/72 |
| 4,548,372 | 10/1985 | Lutzker | 248/99 |
| 4,664,348 | 5/1987 | Corsaut, III et al. | 248/99 |
| 4,733,309 | 3/1988 | Mori et al. | 358/289 |
| 4,739,166 | 4/1988 | Voshimura et al. | 250/327.2 |
| 4,783,949 | 11/1988 | Chopko | 53/384 |
| 4,810,874 | 3/1989 | Torii | 250/327.2 |
| 4,832,292 | 5/1989 | Beckham | 248/99 |
| 4,884,603 | 12/1989 | Simpson | 141/390 |
| 4,921,193 | 5/1990 | Benesch | 248/97 |
| 5,040,755 | 8/1991 | Dineen et al. | 248/99 |
| 5,058,878 | 10/1991 | Hochbein et al. | 271/163 X |
| 5,065,965 | 11/1991 | Aulabaugh | 248/99 |
| 5,080,308 | 1/1992 | Franks | 248/99 |
| 5,085,419 | 2/1992 | Bell | 271/9 |
| 5,095,209 | 3/1992 | Tamura | 250/327.2 |
| 5,095,685 | 3/1992 | Latham | 53/473 |
| 5,129,526 | 7/1992 | Craft, Jr. et al. | 206/449 |
| 5,172,905 | 12/1992 | Vanous et al. | 271/209 |
| 5,199,695 | 4/1993 | Nakahata et al. | 271/9 |
| 5,292,114 | 3/1994 | McConnell | 271/241 X |

FOREIGN PATENT DOCUMENTS

| | | | |
|---|---|---|---|
| 37549 | 3/1979 | Japan | 271/1 |
| 110197 | 4/1992 | Japan | 206/449 |

*Primary Examiner*—Robert P. Olszewski
*Assistant Examiner*—Boris Milef
*Attorney, Agent, or Firm*—Thomas H. Close

[57] ABSTRACT

Documents before and after scanning are handled by providing a document container having: a bottom, two side walls, and one end wall; a lid hinged to the body near the one end wall, the lid defining a top and an opposite end wall; the bottom having a cutout opposite the one end wall to facilitate manually removing a stack of documents from the container when the lid is open; and a latch for releasable holding the lid closed against the body. The document container is supported at an angle with fits lid open and the one end wall at the top on a container support having a pair of tabs for aligning a bottom edge of documents placed in the container and limiting the height of a stack of documents placed in the container. A stack of documents is loaded in the document container and the container is closed and latched. The container is then transported with the aligned edge of the documents down to a document scanner input station. The documents are removed from the container and the stack of documents is placed in the scanner input station with the aligned edge toward a set of feed rollers. A document receiving container is provided at an output station of the document scanner for receiving scanned documents in the order of scanning. After the documents are scanned, the document receiving container is removed from the output station and stored.

3 Claims, 3 Drawing Sheets

METHOD FOR HANDLING DOCUMENTS AT A HIGH VOLUME SCANNER

FIELD OF INVENTION

The present invention relates to document handling apparatus and methods, and more particularly to apparatus for securely handling documents that are being scanned in a scanner.

BACKGROUND OF THE INVENTION

In some document scanning operations a large number of loose documents are scanned to record the documents electronically, and then the original documents are stored. It is often imperative that the original documents are maintained in their original order. For example in a program to handle documentation for the U.S. Internal Revenue Service, all U.S. tax returns and associated documents will be processed, scanned and stored within IRS Service Centers. Individual taxpayer submissions are prepared for scanning by removing all paper fasteners, such as staples, paper clips, rubber bands, etc., at a document preparation area and are moved to the scanner for scanning. The documents must be moved to the scanner in such a manner that they are not lost, reshuffled or dropped.

The documents to be scanned are often of various sizes, thicknesses and states of disrepair. Many document scanners, such as the Kodak IMAGELINK Scanner 900 or 923, feed documents from a stack of documents that are aligned along a common edge. In the document handling process prior to scanning it is therefore required to establish a "common edge" for the documents to be grasped by the front feed rollers of the scanner's paper transport mechanism. In addition, for the IMAGELINK 900 and 923 Scanners, only a stack of documents whose height does not exceed 1.5 inches (3.75 cm) can be reliably fed in the scanner.

After the documents are scanned, it is necessary that all of the documents are collected and retrieved from the scanner in the order in which they were scanned, and moved to a document storage area. No documents can be misplaced or lost during the movement from the scanner to the document storage area. The existing output tray of the Kodak IMAGELINK Scanner 900/923 does not offer the degree of document security that is desirable in an operation such as (income tax file scanning). The documents can get out of sequence and smaller sized documents can fall out of the tray and become misplaced. In addition, to conserve valuable storage space, it is desirable that the means of storing the documents not take up unnecessary storage space.

SUMMARY OF THE INVENTION

The present invention is directed to overcoming one or more of the problems set forth above. Briefly summarized, according to one aspect of the present invention, documents to be scanned are handled by providing a document container having: a bottom, two side walls, and one end wall; a lid hinged to the body near the one end wall, the lid defining a top and an opposite end wall; the bottom having a cutout opposite the one end wall to facilitate manually removing a stack of documents from the container when the lid is open; and a latch for releasable holding the lid closed against the body. The document container is supported at an angle with its lid open and the one end wall at the top on a container support having alignment means for aligning a bottom edge of documents placed in the container and a stack height limiting means for limiting the height of a stack of documents placed in the container. A stack of documents is loaded in the document container and the container is closed and latched. The container is then transported, with the aligned edge of the documents pointing down, to a document scanner input station. The documents are removed from the container and the stack of documents is placed in the scanner input station with the aligned edge toward a set of feed rollers. A document receiving container is provided at an output station of the document scanner for receiving scanned documents in the order of scanning. After the documents are scanned, the document receiving container containing the scanned documents in the order of scanning is removed from the output station and stored. According to a preferred embodiment, the receiving container is a flexible folder that can be collapsed on the documents to minimize storage space.

The method of the present invention is advantageous in that a high degree of integrity and security is achieved in documents before and after scanning, while maintaining high throughput rates at the production scanners and minimized storage space for the scanned documents.

These and other aspects, objects, features and advantages of the present invention will be more clearly understood and appreciated from a review of the following detailed description of the preferred embodiments and appended claims, and by reference to the accompanying drawings.

DESCRIPTION OF THE PREFERRED EMBODIMENTS

Figure 2:
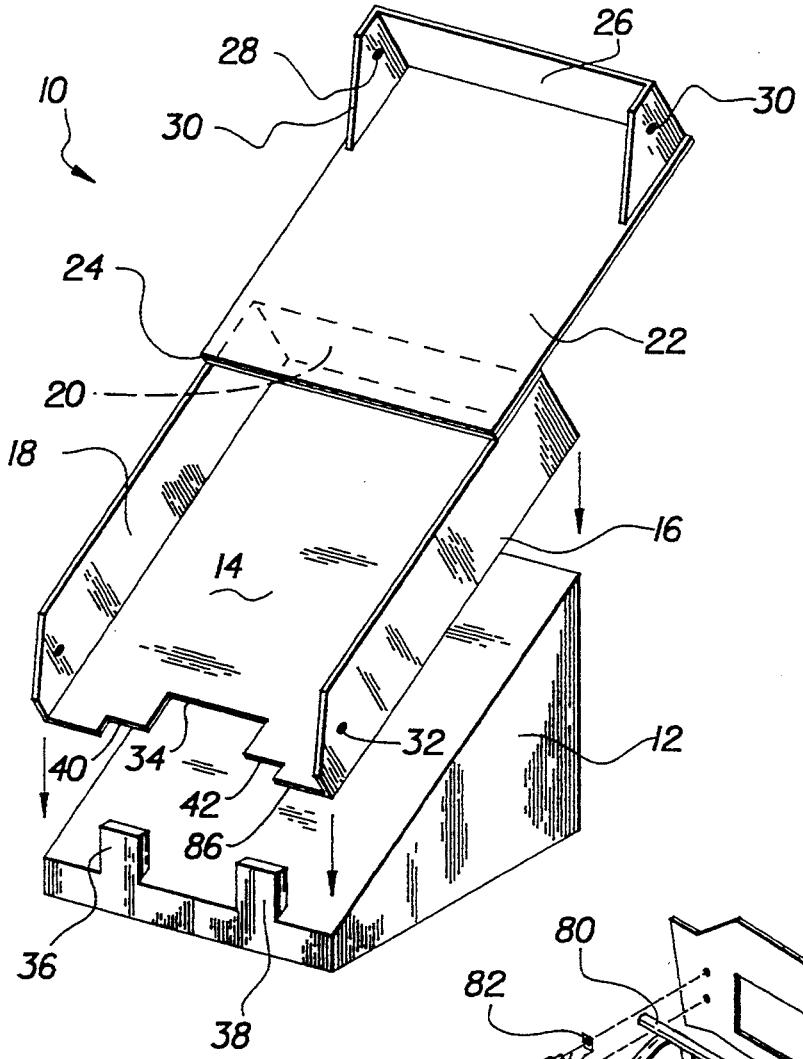
FIG. 2 is a perspective view of a document container and document container support according to one aspect of the present invention.
Figure 4:
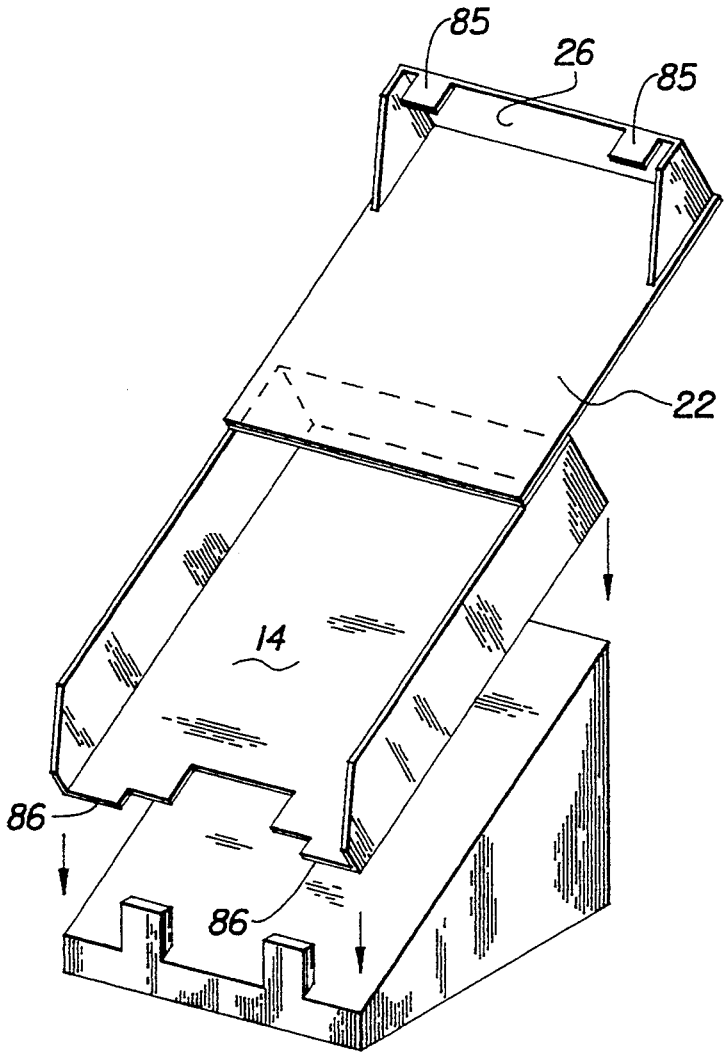
FIG. 4 illustrates an alternate means of providing for a releasable latch.

Referring first to FIG. 2, a document container 10 and document container support 12 are shown. The document container 10 includes a box like body having a bottom 14, two sides 16, 18 and one end wall 20. A lid 22 is attached to the body along a hinge 24. An opposite end wall 26 is carried by lid 22 to cover the lower end of the document container when the lid 22 is closed. A releasable latch is provided by a pair of bosses 28 on a pair of gussets 30 that cooperate with a pair of indents 32 on the sides of the document container. Alternately, an edge lip 85 may be added to the edge of the end wall 26. This lip will snap over the leading edge 86 of the bottom 14 to provide a releasable latch. The lip 85 is engaged by closing the lid 22 and disengaged by manually pulling the end wall 26 away from the leading edge 86 as shown in FIG. 4. The bottom 14 of the document container 10 defines a cutout 34 which facilitates manual grasping of a stack of documents in the container 10.

The document container 10 may be made for example of translucent injection molded plastic (e.g. polypropylene) such that the lid and body portion are molded together in one piece and the hinge 24 is a flexible integral hinge. The physical size of the document container 10 is slightly larger than the largest document that will be scanned.

The document container is designed to cooperate with a document container support 12 which supports the open document container at an angle of about 45° from the horizontal. The document container support 12 includes a pair of alignment tabs 36, 38 that cooperate with notches 40, 42 in the bottom 14 of the document container 10 to position the document container 10 on the document container support 12. When the document container 10 is seated on the document container support 12, the alignment tabs 36, 38 extend above the bottom of the document container. As documents are placed into the document container, the documents slide under the influence of gravity against the tabs 36, 38 to establish a common aligned edge for the stack of documents. The tabs 36, 38 extend above the bottom of the document container by an amount sufficient to allow only a stack of documents of a maximum height to be loaded into the document container. For example 100 folded or wrinkled documents or 150 unwrinkled documents can be loaded onto the document container before the document stack exceeds the height of the tabs 36, 38.

When the document container is full, the document handling clerk closes and latches the lid 22. The document container 10 and the document container support 12 are designed so that the lid 22 may be closed over the retaining tabs 36, 38 and then the document container can be lifted off the support 12. When the document container is lifted off the support 12, the retaining tabs 36, 38 are withdrawn from the document container. This feature allows for a secure method of closing the document container without spilling documents from the container.

Figure 1:
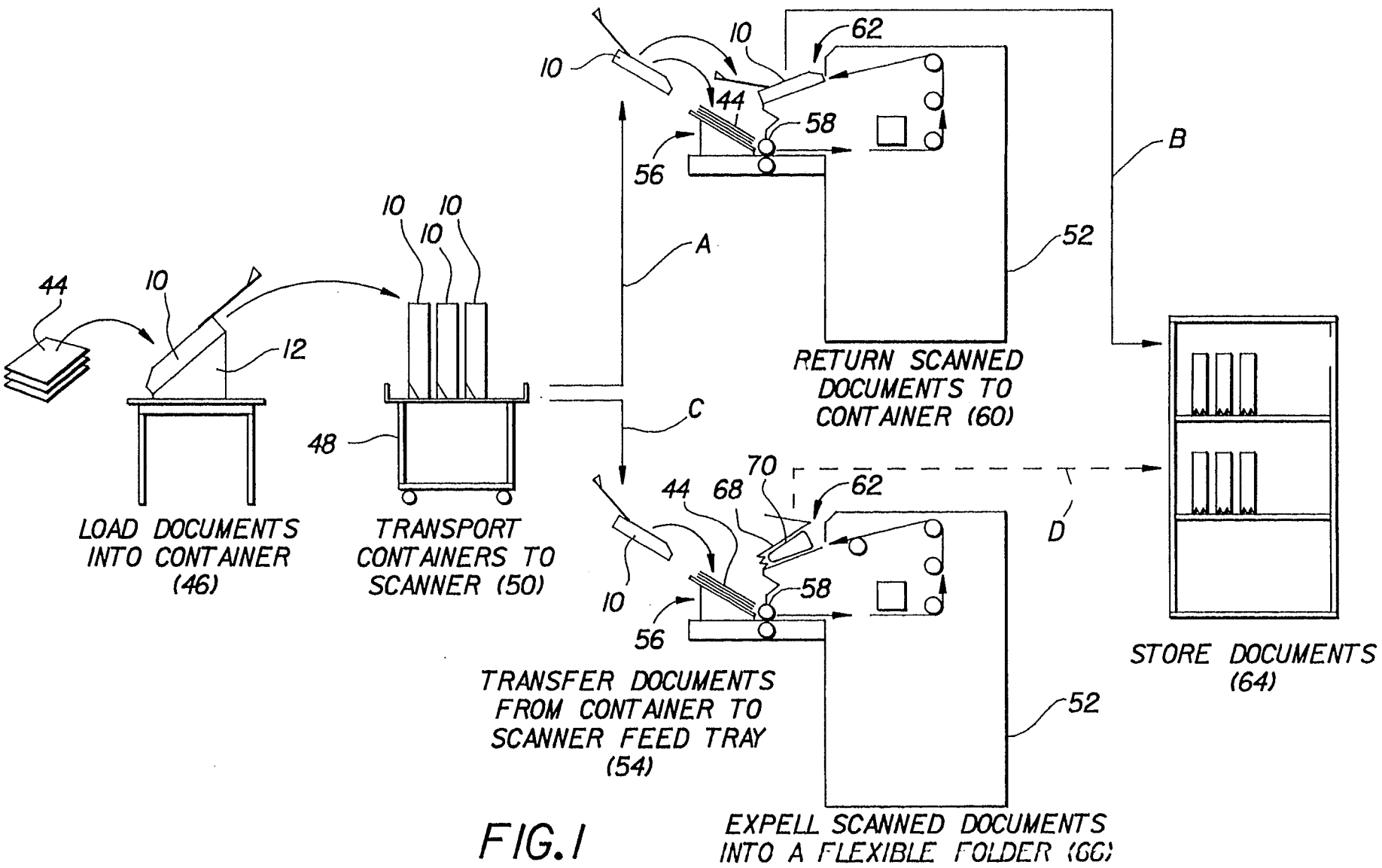
FIG. 1 is a schematic diagram illustrating the method according to the present invention.

Turning now to FIG. 1, the method of handling documents according to the present invention will be described in further detail. The documents 44 are loaded (46) into the document container 10 at a document preparation station. The loaded document containers 10 are then hand carried or placed on a cart 48 to be transported (50) to a scanner with the aligned edges of the documents pointing down so that the documents do not lose their orientation.

When a document container 10 arrives at the scanner 52, (path A in FIG. 1) the scanner operator holds the document container with the aligned edge down and shakes the document container several times to insure that the documents are aligned against the edge of the container attached to the lid. The operator then opens the document container 10, removes the stack of documents 44 from the document container and transfers (54) the stack of documents 44 to the feed station 56 of the scanner 52 with the aligned edge of the stack facing the front auto feed roller 58 of the scanner 52. These actions help to insure acceptable pickup by the auto feed mechanism and trouble-free transport through the scanner.

The documents in the stack are then scanned and returned (60) in their order of scanning to an output station 62 of the scanner 52. The document container 10 is designed to fit into the output station 62 of the scanner 52. The operator places the opened and empty document container 10 into the scanner output station 62 and the scanner discharges the scanned documents directly into the document container 10. The document container 10 is then closed, latched and taken (path B in FIG. 1) to storage (64).

Alternatively, as shown by the paths C and D in FIG. 1, since the document containers 10 may take up more storage space than desired, the documents can be expelled (66) from the scanner 52 into a flexible folder 68 that may then be collapsed upon the stack of documents contained therein to minimize storage space.

Figure 3:
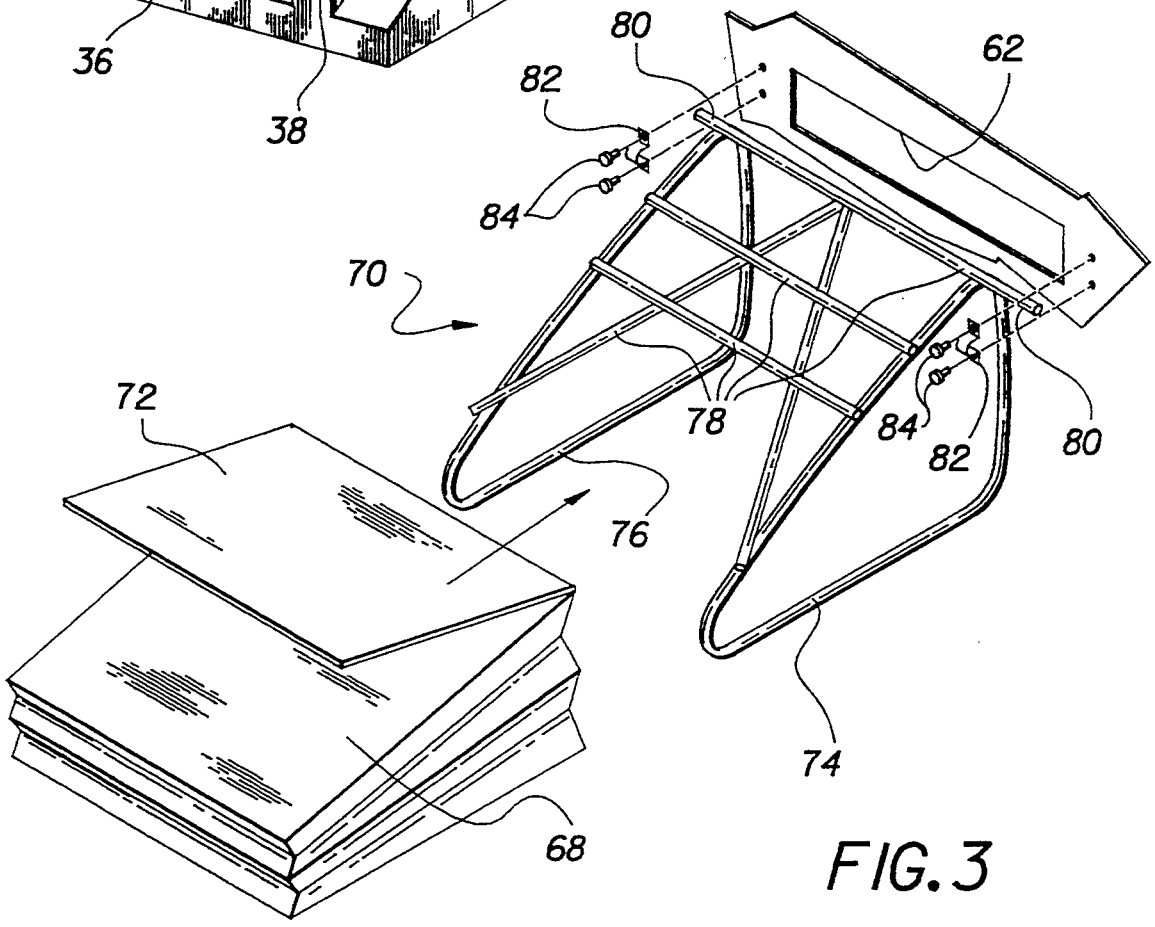
FIG. 3 is a perspective view of a fixture and an expandable folder for receiving documents from the scanner according to one aspect of the present invention.

Referring to FIG. 3, an expandable folder 68 and an attachment 70 for holding the expandable folder open at the exit station of a scanner is shown. The expandable folder 68 is a conventional single pocket accordion folder such as a Smear #M26E "vertical file pocket" measuring 14.75"×9.5"×3.5" and may have a flap 72 for covering the open end of the folder for storage. The attachment 70 is a wire form including a pair of wedge shaped side members 74, 76 that are supported in parallel spaced apart relation by cross members 78. The side members are sized and spaced sufficiently to expand the folder to nearly its full size when the folder attachment is inserted into the folder. One of the cross members 78 defines extensions 80 for mounting the folder attachment 70 to the scanner exit station 62 (shown partially) with brackets 82 and screws 84. The mounting brackets 82 cooperate with the extensions 80 to allow the folder attachment to be pivoted upward to facilitate an operator placing the flexible folder over the folder attachment. The operator takes a folder 68, manually spreads the folder 68 apart and slips the folder over the folder attachment until the ends of the wedge shaped side members 74, 76 contact the bottom of the folder. The attachment with the folder is then lowered into position for receiving scanned documents, as shown in FIG. 1. The scanned documents are then discharged by the scanner directly into the opened folder 68.

When all the documents in the stack 44 have been discharged into the folder 68, the folder is removed from the attachment 70, flap 72 is closed, and the folder with the documents are sent to storage (64).

While the invention has been described with reference to, a system for scanning (income tax files), it is apparent that the invention is easily adapted to other operations such as insurance claims, medical files, etc. that have large numbers of documents that need to be scanned and kept in the order in which they were scanned.

As is evident from the foregoing description, certain aspects of the invention are not limited to the particular details of the examples illustrated, and it is therefore contemplated that other modifications and applications will occur to those skilled in the art. It is accordingly intended that the claims shall cover all such modifications and applications as do not depart from the true spirit and scope of the invention.

PARTS LIST

10 document container
12 document container support
14 bottom
16 side
18 side
20 end wall
22 lid
24 hinge
26 end wall
28 boss
30 gusset
32 indent

34 cutout
36 alignment tab
38 alignment tab
40 notch
42 notch
44 documents
(46) loading step
48 cart
(50) transporting step
52 scanner
(54) transfer step
56 feed station
58 feed roller
(60) returning step
62 output station
(64) storage step
(66) expelling step
68 flexible folder
70 holding attachment
72 flap
74 side member
76 side member
78 cross member
80 extension
82 bracket
84 screw
85 lip
86 leading edge

What is claimed is:

1. A method of handling documents before and after scanning, comprising the steps of:

a. providing a document container having: a body comprising a bottom, two side walls, and one end wall; a lid hinged to the body near said one end wall, said lid defining a top and an opposite end wall; said bottom having a cutout opposite said one end wall to facilitate manually removing a stack of documents from said container when said lid is open; and latch means for releasable holding said lid closed against said body;

b. supporting said container at an angle with its lid open and said one end wall at the top on a container support having alignment means for aligning a bottom edge of documents placed in said container and stack height limiting means for limiting the height of a stack of documents placed in said container;

c. loading a stack of documents in said container;

d. closing and latching said container and transporting said container with the aligned edge of said documents pointing down to a document scanner input station;

e. removing the stack of documents from the container and placing the stack of documents in the scanner input station with the aligned edge toward a set of feed rollers in said input station f. providing a document receiving container at an output station of said document scanner for receiving scanned documents in the order of scanning;

g. scanning said stack of documents; and h. removing said document receiving container containing said scanned documents in the order of scanning from said output station and storing said document receiving container with said scanned documents.

2. The method claimed in claim 1, wherein said document receiving container is a document container as defined in step a.

3. The method claimed in claim 1, wherein said document receiving container is an expandable folder and said document scanner is provided with a fixture at the output station for holding said expandable folder open to receive scanned documents.

* * * * *